US008807822B2

(12) United States Patent
Fripp et al.

(10) Patent No.: US 8,807,822 B2
(45) Date of Patent: Aug. 19, 2014

(54) METHOD AND APPARATUS FOR MIXING FLUID FLOW IN A WELLBORE USING A STATIC MIXER

(71) Applicant: Halliburton Energy Services, Inc., Houston, TX (US)

(72) Inventors: Michael Linley Fripp, Carrollton, TX (US); Ed Patton, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/883,888

(22) PCT Filed: Oct. 11, 2012

(86) PCT No.: PCT/US2012/059719

§ 371 (c)(1),
(2), (4) Date: May 7, 2013

(87) PCT Pub. No.: WO2014/058428

PCT Pub. Date: Apr. 17, 2014

(65) Prior Publication Data

US 2014/0102706 A1 Apr. 17, 2014

(51) Int. Cl.
*B01F 15/02* (2006.01)
*B01F 5/00* (2006.01)

(52) U.S. Cl.
CPC ..... *B01F 5/0057* (2013.01)
USPC ..... 366/181.5; 166/177.7; 166/302

(58) Field of Classification Search
CPC ..... E21B 43/16; E21B 43/24; B01F 2005/06; B01F 2005/0602; B01F 5/0057
USPC ..... 166/177.7, 302; 366/181.5
See application file for complete search history.

(56) References Cited

U.S. PATENT DOCUMENTS

| | | | | |
|---|---|---|---|---|
| 4,981,368 | A | 1/1991 | Smith | |
| 7,581,593 | B2 | 9/2009 | Pankratz et al. | |
| 8,147,124 | B1 | 4/2012 | Glanville | |
| 2002/0031046 | A1 | 3/2002 | Schneider et al. | |
| 2009/0071646 | A1 * | 3/2009 | Pankratz et al. | 166/265 |
| 2009/0071647 | A1 * | 3/2009 | Vinegar et al. | 166/266 |

FOREIGN PATENT DOCUMENTS

JP 09-187634 7/1997

OTHER PUBLICATIONS

International Search Report dated Apr. 8, 2013 for PCT Application No. PCT/US2012/059719.
Written Opinion dated Apr. 8, 2013 for PCT Application No. PCT/US2012/059719.

* cited by examiner

*Primary Examiner* — Yong-Suk (Philip) Ro
(74) *Attorney, Agent, or Firm* — John W. Wustenberg; Booth Albanesi Schroeder LLC

(57) ABSTRACT

Methods and apparatus are presented for mixing fluid flowing through a wellbore extending through a subterranean formation. A static mixer assembly is positioned in a tubing string, the mixer having a plurality of vanes extending radially into an interior fluid flow passageway. Downhole tools are movable through a tool passageway defined in the static mixer assembly. The tools can pass unobstructed by the fixed vanes. Alternately, the tool can flex the elastic vanes as it passes through, the vanes returning to position after passage of the tool. The vanes are preferably circumferentially spaced and longitudinally spaced. The vanes can extend from an interior wall surface of the assembly or from a sleeve inserted into the mixer assembly.

20 Claims, 5 Drawing Sheets

METHOD AND APPARATUS FOR MIXING FLUID FLOW IN A WELLBORE USING A STATIC MIXER

CROSS-REFERENCE TO RELATED APPLICATIONS

None.

FIELD OF INVENTION

Generally, methods and apparatus for mixing fluid flow in a wellbore tubular using a static mixer is presented. More particularly, methods and apparatus are presented for mixing two or more fluids flowing through a downhole tubular positioned in a wellbore, utilizing static mixing elements, and while without blocking a passageway sized to allow passage of downhole tools.

BACKGROUND OF INVENTION

It is common in hydrocarbon well operations to have two or more fluids flowing through a downhole tubular positioned in a wellbore extending through a subterranean zone. For example, during production, the fluids in the wellbore tend to separate into zones of gas, water, and oil flow. Such flow phase separation can create unwanted flow instabilities and oscillations. Also, if the gas separates from the oil, the oil is no longer lightened by the gas and can collect in the bottom of the well which would reduce oil production. During injection of steam, mist flow conditions can arise where liquid water sheets down the wall of the injection tubing while the gaseous steam flows down the middle of the tubing. During multizonal injection, such as with Halliburton Energy Services, Inc.'s commercially available ZoneMaster (trade name) tool, separation of gaseous and liquid water often results in unequal gaseous and liquid injection distribution across the wellbore; that is, a relatively greater amount of steam is injected into the upper zones and a relatively greater amount of water is injected into the lower zones. During hydrajet fracturing, a distribution of cutting particles is created in the cross-section of flow. The result is more particles in the center of the tubing and fewer particles towards the tubing wall. This particle distribution tends to result in fewer particles being injected into the upper zones and more particles being injected into the lower zones. Similarly, it is believed this effect may be significant in hydraulic fracturing with regard to proppant distribution in the tubing and proppant concentration depending on exit port locations along the work string.

Downhole mixers are used to mix and homogenize the fluid flow. Dynamic and powered mixer devices may require power sources, effectively block tool passage through the tubing string in the wellbore, or create significant pressure drops across the mixer device. Similarly, downhole static mixer devices often block tool passage, create unwanted pressure drops, or fail to provide desired homogenization. Therefore, a need exists for a downhole static mixer for mixing and homogenizing constituent parts of the downhole fluid flow without blocking tool passage through the tubing string.

SUMMARY OF THE INVENTION

In a preferred embodiment, a method is presented for mixing a fluid flowing through a wellbore extending through a subterranean formation. A static mixer assembly is positioned in a tubing string along the wellbore, the tubing string defining an interior passageway which extends through the static mixer assembly. The static mixer has a plurality of static mixer vanes extending radially into the interior passageway. Fluid is flowed through a fluid passageway defined through the static mixer assembly, the vanes mixing at least two components of the fluid using the static mixer assembly. A downhole tool is then moved through the interior passageway and through the static mixer assembly. The plurality of static mixer vanes are preferably circumferentially spaced apart and longitudinally spaced apart. The vanes can extend from an interior wall surface of the assembly or from a sleeve inserted into the mixer assembly.

In one embodiment, the static mixer vanes define an unobstructed passageway radially inward from the vanes. A downhole tool is then moved through the unobstructed passageway. In a further embodiment, the plurality of vanes are positioned in an annular space defined by a radially enlarged bore section in the static mixer assembly. The plurality of vanes extend only into the annular space in a preferred embodiment. Alternately, the vanes are made of a flexible and elastic material, at least partially, and extend into the tool passageway. The tool flexes the vanes during its passage. The vanes return substantially to their original position after passage of the tool. Hence, the flexible and elastic vanes allow unhindered passage of downhole tools through the mixer assembly. In embodiments wherein the vanes do not contact the tool during passage, such as when the vanes extend only through an annular area defined around the tool passageway, the vanes allow unobstructed passage of the downhole tools.

The radial positioning of the downhole tool during movement through the mixer can be maintained by a plurality of centralizer rods extending between the plurality of static mixer vanes. The vanes can take various shapes and positioning along the mixer assembly, as desired. The vanes can extend substantially perpendicular to fluid flow through the assembly or passageways therein. Further, the vanes can be positioned on an insertable or removable sleeve. Apparatus are presented designed for use in the methods described above.

BRIEF DESCRIPTION OF THE DRAWINGS

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the specification will state or make such clear. For a more complete understanding of the features and advantages of the present invention, reference is now made to the detailed description of the invention along with the accompanying figures in which corresponding numerals in the different figures refer to corresponding parts and in which.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The invention can be used in vertical, horizontal, or deviated wellbores.

Figure 1:
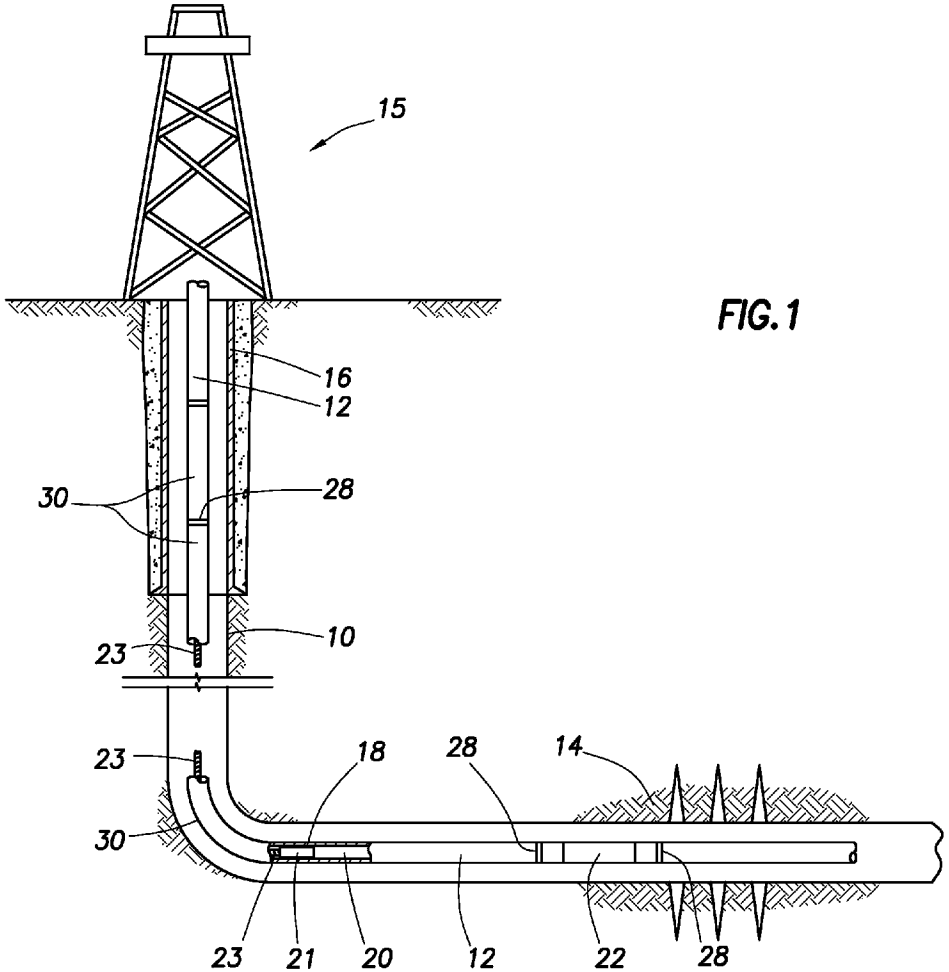
FIG. 1 is a schematic illustration of an exemplary tubing string and wellbore extending through at least one fluid-bearing zone.

FIG. 1 is a schematic illustration of an exemplary tubing string 12 and wellbore 10 extending through at least one fluid-bearing zone 14. The upper portion of the wellbore has a casing 16 which can also extend along further portions of the wellbore. A rig 15 or other equipment, shown at the surface but including offshore and downhole equipment sites, operates on the wellbore, positioning tubing, pumping, extracting and injecting fluids, etc. The tubing string 12 typically consists of a plurality of tubing sections joined together at threaded joints or other connection mechanisms or coiled tubing. "Tubing string," as used herein, includes jointed tubing sections, coiled tubing, work strings, production strings, and any other operational strings. The tubing string 12, shown in partial cross-section, defines therein a flow passageway 18 and a tool passageway 20. The flow passageway allows fluid flow along the length of the tubing string. The tool passageway 20 allows passage of downhole tools 21 through the tubing string. For example, smaller tool-bearing tubing, tools lowered on wireline 23, etc., can be moved upwardly or downwardly through the tool passageway. Note that the tool passageway and flow passageway may overlap, coincide, etc. A static mixer assembly 22 is shown positioned along the tool string 12. One or more such assemblies may be used in a wellbore. The static mixer assembly 22 mixes fluid flowing through the interior of the assembly. Multiple such assemblies can be employed on a string. Additional tools and features can be employed on the string as are known in the art.

Figure 2:
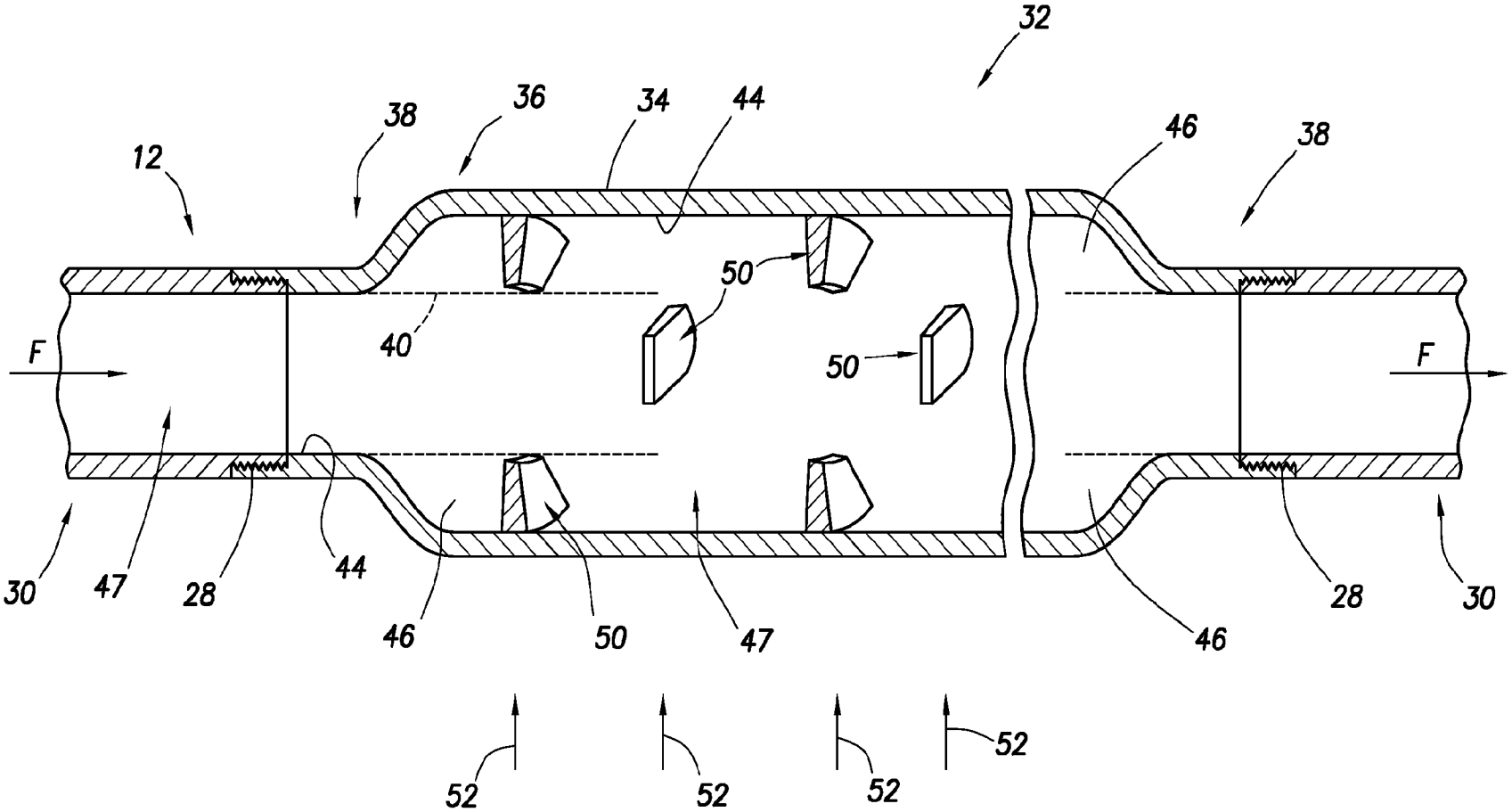
FIG. 2 is a schematic view of an exemplary static mixer assembly positioned in a tubing string according to an aspect of the invention.

FIG. 2 is a schematic view of an exemplary static mixer assembly positioned in a tubing string according to an aspect of the invention. The tubing string 12 includes, in this exemplary embodiment, multiple tubing sections 30 connected together, such as at threaded connections 28, or otherwise, as is known in the art. Part of the tubing string 12 is an exemplary static mixer assembly 32. The static mixer assembly has a substantially tubular tool body 34, preferably having a radially expanded portion 36 along part of its length, preferably positioned between relatively narrower diameter portions 38. The mixer assembly defines a tool passageway 40 through which tools can pass unhindered or unobstructed by the mixing elements 50. A portion of the tool passageway may be defined by the interior wall 44 of the tubular, such as at portions 38 as shown. Note also that the tool passageway also allows fluid flow through the tubular. The fluid passageway may overlap, be coextensive with, or include, etc., the tool passageway. In the preferred embodiments shown, the flow passageway 47 is defined by the interior wall 44 of the tubular.

The interior wall 44 at the radially expanded portion 36 defines an annular space 46 about the tool passageway. A plurality of relatively flat, static, circumferentially spaced and longitudinally spaced mixing vanes 50 extend radially from the interior wall 44 into the annular space 46. In the embodiment having static vanes which do not move out of the way of downhole tools passing through the static mixer, the annular space 46 can be thought of as defined between a relatively smaller diameter (d) cylinder positioned interior to the vanes, and a relatively larger diameter (D) cylinder coincident with the inner surface of the tubular wall. Similarly, the fluid flow passage may be defined by the surface of the tubular wall. The tool passageway can be defined by the relatively smaller diameter cylinder described above.

The vanes are shown extending substantially perpendicular to fluid flow through the interior flow passageway of the tubular. Alternate arrangements of vanes are possible, including staggered vanes, circumferential vanes, etc. As used herein, "vane," indicates a generally flat, thin projection extending into, and designed to substantially disrupt and mix, the fluid flow. Exemplary vanes extend laterally to the direction of flow to maximize disruption of separated flow phases.

In a preferred embodiment, the plurality of static vanes 50 are arranged in rows 52 spaced longitudinally along the tubular body 34 and positioned in the annular space 46. In a preferred embodiment, the vanes 50 are rigid and inflexible. The vanes can be made of metal, plastic or other suitable material. The vanes can be welded or otherwise attached to the wall of the tubular. More or fewer vanes and rows can be employed than shown in the Figures.

Figure 3:
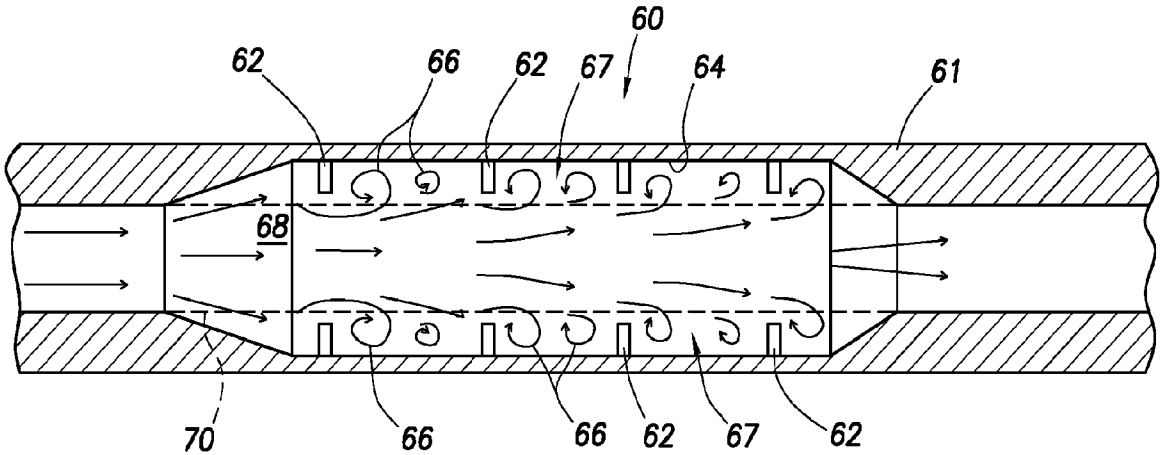
FIG. 3 is a schematic view of an exemplary embodiment of a downhole static mixer assembly 60 according to an aspect of the invention.

FIG. 3 is a schematic view of an exemplary embodiment of a downhole static mixer assembly 60 according to an aspect of the invention. For the high flow rates typically encountered in most oilfield applications, the Reynold's number places the flow in the turbulent region. As a result, a series of vanes 62 extending radially inward from the interior wall 64 of the tubular tool body 61 are used to create turbulent flow 67, causing eddies 66, in the flow passageway 68 defined by the tubular. An eddy 66 is created downstream of vane 62. Eddies caused by the vanes may be "rolling eddies," that is, an eddy caused just downstream of a vane can then move downstream while another eddy forms in the area vacated by the original eddy. The vortices caused by the flow eddies serve to mix or homogenize the components or phases of the fluid. The mixed fluid reduces or eliminates the uneven flow distributions that otherwise would arise during injection, production, or fracturing operations. The static flow vanes create turbulence in the flow which disrupts boundary layers created by the separated flow.

The assembly defines a tool passageway 70 allowing the unobstructed passage of downhole tools through the assembly. The tool passageway can be coincident with or smaller than and positioned within the flow passageway. The flow passageway is typically defined by the interior wall surface, as the fluid is free to flow in the entire open area of the passageway. The tool passageway, in a preferred embodiment, is defined by a cylinder coincident with the most radially inward portion of the vanes or centralizers, explained below. Where the vanes are flexible and elastic, as explained elsewhere, the vanes may extend radially into the tool passageway, but their flexibility allows unhindered passage of tools.

The vanes create turbulent flow which serves to redistribute separated phases. The result is a system that mixes the flow while not restricting tool passage. Another feature of the invention is that the projections result in minimal pressure drop. The goal is to mix the flow while avoiding undue pressure drop across the projections. The vanes are designed to maximize mixing while minimizing pressure drop.

Figure 4A:
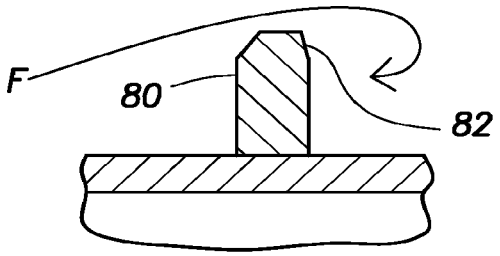
FIGS. 4A-C are schematic cross-sectional views of exemplary static vanes according to an aspect of the invention.
Figure 4B:
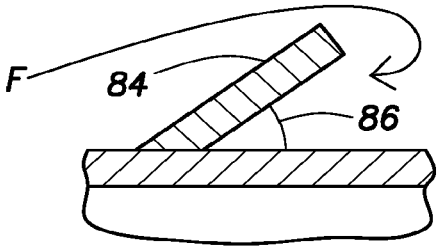
Figure 4C:
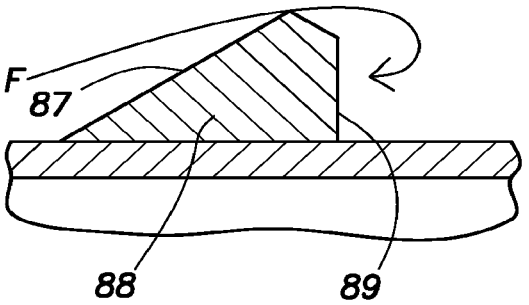

FIGS. 4A-C are schematic cross-sectional views of exemplary static vanes according to an aspect of the invention. FIG. 4A shows a static vane 80 having a substantially rectangular cross-section and creating turbulent flow as indicated by the arrow. The vane 80 can have shaped or beveled edges 82 if desired. The vanes are shown as substantially perpendicular to the longitudinal axis of the tool. FIG. 4B shows a static vane 84 angled 86 in the direction of fluid flow along the fluid passageway and creating turbulent flow. FIG. 4C shows a vane 88 varying in thickness along its height. The vanes create turbulent flow. The front surface 87 of the vane and the rear surface 89 of the vane can be at different angles, as shown. Various alternative embodiments of vane shape, arrangement and position will be recognized by practitioners. The vanes have an effective height, the distance they extend into the fluid passageway. Preferably the height of the vanes is about one-quarter to one-half inch, although heights as little as one-tenth of an inch can be used.

Figure 5A:
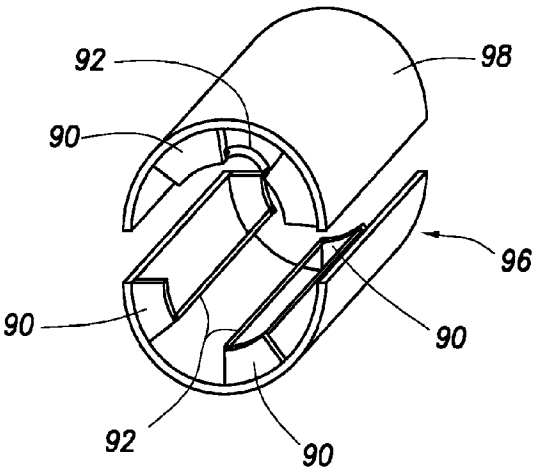
FIGS. 5A-B are schematic views of a section of an exemplary embodiment of the invention having static vanes and centralizing and supporting longitudinal rods.
Figure 5B:
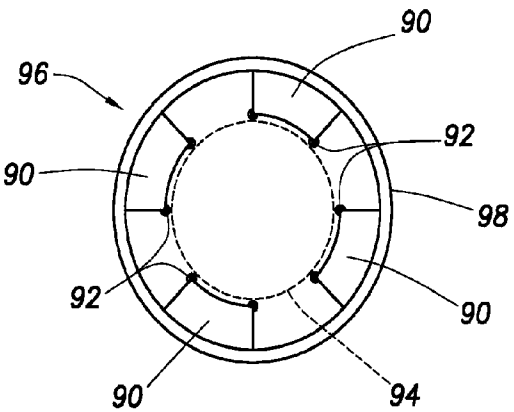

FIG. 5 is a schematic, partial view of an exemplary embodiment of the invention having static vanes and centralizing and supporting longitudinal rods. FIG. 5B shows an elevational side cross-section view and FIG. 5A shows a corresponding orthogonal, exploded, end view. The views are of a radially expanded portion 98 of a static mixer assembly. In a preferred embodiment, the vanes extend radially into the flow passageway of the tubular but do not extend into the tool passageway. In such an embodiment, the static vanes do not hinder or obstruct movement of a tool through the tool passageway. As seen in FIG. 5, the vanes 90 can be supported by a plurality of longitudinally extending rods 92, each attached to a plurality of vanes. The rods 92 can also centralize any tool moving through the static mixer assembly. The rods 92 are shown as cylindrical but can take other shape. Similarly, the rods are shown as extending longitudinally and not laterally, although other arrangements can be used. In such an embodiment, the vanes and rods can define a tool passageway 94 through the tubular 96. The support rods are shown positioned at the upper surface of the vanes, but can be located elsewhere, such as at the sides of the vanes as desired.

Figure 6:
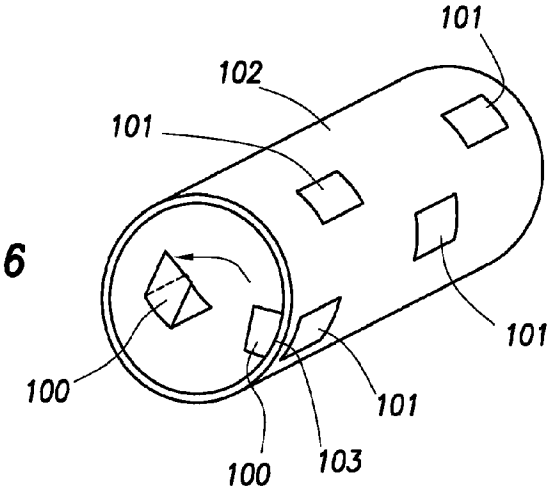
FIG. 6 is a schematic view of an exemplary embodiment according to an aspect of the invention showing a sleeve having vanes, the sleeve for positioning in a static mixer tubular.

FIG. 6 is a schematic view of an exemplary embodiment according to an aspect of the invention showing a sleeve having vanes, the sleeve for positioning in a static mixer tubular. For ease of manufacture and assembly, the vanes 100 can be formed from and attached to a sleeve 102 or liner. The sleeve 102 can then be inserted into the tubular body 104 of a static mixer assembly. In a preferred embodiment, the sleeve 102 is a thin-walled tubular, for example, of sheet metal. Preferably, the vanes 100 are "cut-out" tabs bent inwardly from the sleeve leaving corresponding cut-out openings 101 in the sleeve 102 wall 103. The cut sheet metal tubular is then inserted like a liner in a tubular. The tabs are shown as rectangular but other shapes may be cut as desired.

Figure 7:
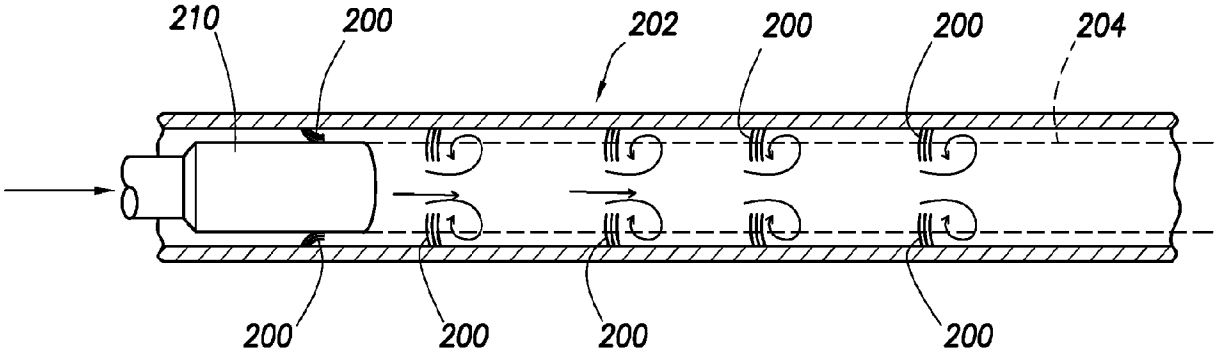
FIG. 7 is a schematic cross-sectional view of an exemplary embodiment of the invention having flexible vanes.

FIG. 7 is a schematic cross-sectional view of an exemplary embodiment of the invention having flexible vanes. In another embodiment, the vanes 200 of the static mixing assembly 202 are flexible and bend out of the way to allow unhindered passage of tools through the tool passageway 204, which can be defined by the interior space of the tubular body 206 or by some cylinder of smaller diameter therein. The flexible vanes 200 extend radially inward from the tubular wall 208 and into the tool passageway. In a preferred embodiment, the tubular body 206 has an inner passageway of uniform diameter. The tool passageway is slightly smaller than the tubular body inner diameter. The flexible vanes can be used in conjunction with an expanded radial section (such as that seen in FIG. 2 for example) wherein the vanes are positioned in the annular space and extend into the tool passageway.

In use, the flexible vanes 200 extend into the tool passageway 204. The vanes 200 bend out of the tool passageway 204 when a tool passes therethrough. The flexible vanes 200 can be made of any suitable material, such as elastically deforming plastic, rubber, memory materials, etc. Further, each vane can be made of more than one material. For example, the vane base can be rigid while the vane tip is flexible.

An exemplary downhole tool 210 is shown being moved into the static mixer assembly in FIG. 7. The exterior of the tool 210 pushes and bends the flexible vanes 200 as it passes through the tool passageway. Although the tool 210 and vanes 200 interact and contact one another, the flexibility of the vanes allows unhindered passage for the tool. The vanes are flexible and elastic, returning to approximately the same position after passage of the tool.

The inventive apparatus described herein can be employed in inventive processes and methods. It is common in hydrocarbon well operations to have two or more fluids flowing through a downhole tubular positioned in a wellbore extending through a subterranean zone. For example, during production, the fluids in the wellbore tend to separate into zones of gas, water, and oil flow. Such flow phase separation can create unwanted flow instabilities and oscillations. Also, if the gas separates from the oil, the oil is no longer lightened by the gas and can collect in the bottom of the well which would reduce oil production. During injection of steam, mist flow conditions can arise where liquid water sheets down the wall of the injection tubing while the gaseous steam flows down the middle of the tubing. During multi-zonal injection, such as with Halliburton Energy Services, Inc.'s commercially available ZoneMaster (trade name) tool, separation of gaseous and liquid water often results in unequal gaseous and liquid injection distribution across the wellbore; that is, a relatively greater amount of steam is injected into the upper zones and a relatively greater amount of water is injected into the lower zones. During hydrajet fracturing, a distribution of cutting particles is created in the cross-section of flow. The result is more particles in the center of the tubing and fewer particles towards the tubing wall. This particle distribution tends to result in fewer particles being injected into the upper zones and more particles being injected into the lower zones. Similarly, it is believed this effect may be significant in hydraulic fracturing with regard to proppant distribution in the tubing and proppant concentration depending on exit port locations along the work string.

In preferred embodiments, the following exemplary methods are disclosed. A method for mixing a fluid flowing through a wellbore extending through a subterranean formation, the method comprising the steps of: positioning a static mixer assembly in a tubing string along the wellbore, the tubing string defining an interior passageway which extends through the static mixer assembly, the static mixer having a plurality of static mixer vanes extending radially into the interior passageway; flowing a fluid through a fluid passageway defined through the static mixer assembly; mixing at least two components of the fluid using the static mixer assembly; and moving a downhole tool through the interior passageway and through the static mixer assembly. Additional steps and structure can include, without limitation and in combination, wherein the plurality of static mixer vanes are circumferentially spaced apart and longitudinally spaced apart; wherein the static mixer assembly has a substantially tubular wall having an interior surface, and the plurality of vanes extending from the interior surface; wherein the static mixer vanes define an unobstructed passageway, and wherein the step of moving a downhole tool further comprises the step of moving the downhole tool through the unobstructed passageway; the static mixer having a bore extending therethrough, and wherein the plurality of static mixer vanes are positioned in an annular space defined by a radially enlarged bore section in the static mixer assembly; wherein the step of mixing further includes mixing the fluid components in an annular space defined adjacent to and radially outward from the interior passageway; wherein the step of moving a downhole tool further comprises maintaining the radial positioning of the tool during movement using a plurality of centralizer rods extending between the plurality of static mixer vanes; wherein the step of moving the downhole tool further comprises the step of temporarily moving at least a portion of each static mixer vane using the downhole tool; further comprising the step of removing from or inserting into the static mixer assembly a sleeve, the plurality of vanes extending from the sleeve; wherein the static mixer vanes are at least partially made of a flexible and elastic material; wherein the static mixer vanes allow unhindered passage of a downhole tool through the static mixer assembly; wherein the step of mixing further comprises the step of mixing components in different phases; wherein the static mixer vanes extend substantially perpendicular to the path of fluid flow through the tubing string.

In a preferred embodiment, a method is presented for mixing a fluid flowing through a wellbore extending through a subterranean formation. A static mixer assembly is positioned in a tubing string along the wellbore, the tubing string defining an interior passageway which extends through the static mixer assembly. The static mixer has a plurality of static mixer vanes extending radially into the interior passageway. Fluid is flowed through a fluid passageway defined through the static mixer assembly, the vanes mixing at least two components of the fluid using the static mixer assembly. A downhole tool is then moved through the interior passageway and through the static mixer assembly. The plurality of static mixer vanes are preferably circumferentially spaced apart and longitudinally spaced apart. The vanes can extend from an interior wall surface of the assembly or from a sleeve inserted into the mixer assembly.

In one embodiment, the static mixer vanes define an unobstructed passageway radially inward from the vanes. A downhole tool is then moved through the unobstructed passageway. In a further embodiment, the plurality of vanes are positioned in an annular space defined by a radially enlarged bore section in the static mixer assembly. The plurality of vanes extend only into the annular space in a preferred embodiment. Alternately, the vanes are made of a flexible and elastic material, at least partially, and extend into the tool passageway. The tool flexes the vanes during its passage. The vanes return substantially to their original position after passage of the tool. Hence, the flexible and elastic vanes allow unhindered passage of downhole tools through the mixer assembly. In embodiments wherein the vanes do not contact the tool during passage, such as when the vanes extend only through an annular area defined around the tool passageway, the vanes allow unobstructed passage of the downhole tools.

The radial positioning of the downhole tool during movement through the mixer can be maintained by a plurality of centralizer rods extending between the plurality of static mixer vanes. The vanes can take various shapes and positioning along the mixer assembly, as desired. The vanes can extend substantially perpendicular to fluid flow through the assembly or passageways therein. Further, the vanes can be positioned on an insertable or removable sleeve. Apparatus are presented designed for use in the methods described above.

Exemplary methods of use of the invention are described, with the understanding that the invention is determined and limited only by the claims. Those of skill in the art will recognize additional steps, different order of steps, and that not all steps need be performed to practice the inventive methods described. Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

It is claimed:

1. A method for mixing a fluid flowing through a wellbore extending through a subterranean formation, the method comprising the steps of:

positioning a static mixer assembly in a wellbore between and connected to an upper and a lower tubing string, the upper and lower tubing string each having a substantially tubular wall defining axially extending interior passageways, the static mixer assembly having a solid, substantially tubular wall defining an axially extending interior passageway and having a plurality of static mixer vanes extending radially from the tubular wall of the static mixer assembly and into the interior passageway of the static mixer assembly;

flowing a fluid mixture of two or more components from the interior passageway of one of the upper or lower tubing strings, into and through the interior passageway of the static mixer assembly, and into the interior passageway of the other of the upper and lower tubing string;

mixing the at least two components of the fluid using the static mixer assembly; and moving a downhole tool through the interior passageway of the upper and lower tubing string and through the interior passageway of static mixer assembly.

2. The method as in claim 1, wherein the plurality of static mixer vanes are circumferentially spaced apart and longitudinally spaced apart.

3. The method as in claim 1, wherein the static mixer vanes define an unobstructed passageway, and wherein the step of moving a downhole tool further comprises the step of moving the downhole tool through the unobstructed passageway.

4. The method as in claim 1, the static mixer having a bore extending therethrough, and wherein the plurality of static mixer vanes are positioned in an annular space defined by a radially enlarged bore section in the static mixer assembly.

5. The method as in claim 1, wherein the step of moving a downhole tool further comprises maintaining the axial positioning of the tool during movement using a plurality of centralizer rods extending between the plurality of static mixer vanes.

6. The method as in claim 1, wherein the step of moving the downhole tool further comprises the step of temporarily moving at least a portion of each static mixer vane using the downhole tool.

7. The method as in claim 1, further comprising the step of removing from or inserting into the static mixer assembly a sleeve, the plurality of vanes extending from the sleeve.

8. The method as in claim 1, wherein the static mixer vanes allow unhindered passage of a downhole tool through the static mixer assembly.

9. A static fluid mixer system for mixing fluid flowing through a downhole tubular positioned in a subterranean wellbore extending through a hydrocarbon-bearing zone, the system comprising:

a work string positioned in the wellbore; and a static mixer assembly positioned on the work string, the static mixer assembly having:

a tool body having a solid interior wall, a flow passageway defined through the tool body, and an unobstructed tool passageway defined through the tool body of a size to allow passage of a downhole tool therethrough;

a plurality of static mixer vanes extending radially from the interior wall into the flow passageway; and a fluid mixture of two or more components flows from an interior passageway of one of upper or lower tubing strings, into and through the flow passageway of the static mixer assembly, and into the interior passageway of the other of the upper and lower tubing string.

10. A system as in claim 9 wherein the plurality of vanes are circumferentially spaced and longitudinally spaced along the fluid passageway.

11. A system as in claim 9, wherein the plurality of vanes extend substantially perpendicular to fluid flow through the tool passageway.

12. A system as in claim 11, wherein at least a portion of each vane is made of a flexible and elastic material.

13. A system as in claim 9, wherein the tool body has a radially expanded section defined by a radially expanded length of the interior wall, the radially expanded section defining an annular space extending longitudinally along the tool.

14. A system as in claim 9, wherein the static mixer assembly further comprises a plurality of centralizer members extending longitudinally along the tool body for centralizing downhole tools as they pass through the tool passageway.

15. A static mixer assembly for use in mixing fluid flowing through a downhole tubular positioned in a subterranean wellbore, the assembly comprising:

a static mixer assembly positionable on a work string, the static mixer assembly having a fluid flow passageway defined through the tool body, and a tool passageway defined through the tool body, the tool passageway of a size to allow passage of a downhole tool therethrough;

a plurality of static mixer vanes extending radially into the flow passageway and allowing passage of a downhole tool through the tool passageway; and a fluid mixture of two or more components flows from an interior passageway of one of upper or lower tubing strings, into and through the flow passageway of the static mixer assembly, and into the interior passageway of the other of the upper and lower tubing string.

16. The assembly of claim 15, wherein the plurality of static mixer vanes are spaced apart longitudinally and circumferentially.

17. The assembly of claim 15, wherein the plurality of static mixer vanes are flexible to allow passage of a downhole tool through the tool passageway and elastic to return substantially to their initial position after passage of the downhole tool.

18. The assembly as in claim 15, wherein the plurality of static mixer vanes extends into the fluid flow passageway and partially into the tool passageway.

19. The assembly as in claim 15, wherein the static mixer assembly is operable to substantially mix at least two components of the fluid flow, wherein the two components are in different phase initially.

20. The assembly as in claim 15, further comprising a sleeve insertable into the static mixer assembly, the plurality of static mixer vanes extending radially inward from the sleeve.

* * * * *